United States Patent [19]

Ishihara et al.

[11] Patent Number: 4,768,268

[45] Date of Patent: Sep. 6, 1988

[54] METHOD FOR MANUFACTURING A SINGLE-PIECE TYPE VALVE SLEEVE

[75] Inventors: Masahito Ishihara, Kani; Masahito Iwata, Seto, both of Japan

[73] Assignee: Tokai TRW & Co., Ltd., Aichi, Japan

[21] Appl. No.: 18,275

[22] Filed: Feb. 24, 1987

[30] Foreign Application Priority Data

Feb. 24, 1986 [JP] Japan ..... 61-37289

[51] Int. Cl.[4] ..... B21D 53/00

[52] U.S. Cl. ..... 29/157.1 R; 29/558; 72/370

[58] Field of Search ..... 29/157.1 R, 151 R, 557, 29/558; 72/325, 324, 340, 356, 370

[56] References Cited

U.S. PATENT DOCUMENTS

| | | | |
|---|---|---|---|
| 1,422,655 | 7/1922 | Brehmer . | |
| 1,714,398 | 5/1929 | O'Bannon . | |
| 1,829,022 | 10/1931 | Stevenson . | |
| 1,870,970 | 8/1932 | Stevenson . | |
| 2,382,349 | 8/1945 | Taylor . | |
| 2,963,774 | 12/1960 | Pike . | |
| 3,157,943 | 11/1964 | Wurzburger . | |
| 3,177,562 | 4/1965 | Worner et al. . | |
| 4,276,812 | 7/1981 | Dymond . | |
| 4,292,831 | 10/1981 | Simon . | |
| 4,419,877 | 12/1983 | Alfano . | |
| 4,450,704 | 5/1984 | Schaeffler et al. . | |
| 4,535,519 | 8/1985 | Kajikawa et al. . | |
| 4,614,014 | 9/1986 | Ferguson . | |
| 4,689,864 | 9/1987 | Fukuna | 29/157.1 R |

FOREIGN PATENT DOCUMENTS

| | | | |
|---|---|---|---|
| 0189028 | 10/1984 | Japan | 29/157.1 R |
| 60-3893 | 1/1985 | Japan . | |
| 60-73175 | 4/1985 | Japan . | |
| 0210339 | 10/1985 | Japan | 29/157.1 R |
| 86/03705 | 7/1986 | PCT Int'l Appl. | 29/157.1 R |
| 771256 | 3/1957 | United Kingdom . | |

*Primary Examiner*—P. W. Echols
*Assistant Examiner*—Irene Cuda
*Attorney, Agent, or Firm*—Tarolli, Sundheim & Covell

[57] ABSTRACT

A method for manufacturing a single-piece type valve sleeve, includes plastic-working a workpiece thereby to form in the workpiece a blind bore and a plurality of grooves in the surface of the bore and extending lengthwise of the bore, plastic-working a portion of the workpiece at the bottom of the bore so as to form a through hole in the workpiece, and plastic-working an inner portion of the workpiece adjacent the mouth of the bore thereby to close one end of the grooves. A single-piece type valve sleeve is produced by the method.

8 Claims, 2 Drawing Sheets

METHOD FOR MANUFACTURING A SINGLE-PIECE TYPE VALVE SLEEVE

INDUSTRIAL FIELD OF THE INVENTION

This invention relates to a method for manufacturing a single-piece type valve sleeve for use in a power steering device or the like.

PRIOR ART

As well known, a valve sleeve is formed with a plurality of grooves (oil grooves) in the inner surface thereof so as to function as a selector valve or directional control valve for power steering in co-operation with a land portion of an input shaft.

In conventional two-piece or three-piece type valve sleeves, after such grooves are formed, a ring is press-fitted into an end or both ends of a valve sleeve body thereby to close both ends of the grooves in the inner surface of the valve sleeve by means of the ring or rings. For example, see Japanese Patent Publication No. 60-3893.

In addition to such two-piece or three-piece type valve sleeves, a single-piece type valve sleeve consisting of a valve sleeve body only is disclosed, for instance in Japanese Patent Laying-Open Nos. 54-132935 and 60-73175.

Japanese Patent Laying-Open No. 55-119564 discloses a single-piece type valve sleeve in which grooves are pre-formed in a valve sleeve by broaching or by passing a similar cutting tool through the sleeve and thereafter an annular bead or beads is or are formed by extrusion so as to close an end or the ends of each groove.

However, those conventional valve sleeves normally have grooves formed by cutting. In the case of such grooves formed by cutting, it takes a few minutes to form one groove. Thus, it takes a long time to finish one valve sleeve.

In particular, in a single-piece type valve sleeve, as disclosed in Japanese Patent Laying-Open No. 54-132935, its production cost is high because a complicated machine for cutting an inner surface of a workpiece must be used.

According to the conventional methods for manufacturing valve sleeves, size accuracy of valve sleeves largely depends upon the precision of cutting machines, the cutting performance of cutting tools, the precision of jigs, the inner surface grinding characteristics of the valve blanks and so on. Therefore, inaccurate valve sleeves are often apt to be produced.

According to a manufacturing method as shown in Japanese Patent Laying-Open No. 55-119564, plural grooves having their ends closed must be formed by both cutting and extruding so that the production cost is high. Also, it is extermely difficult to change a cutting operation to an extruding operation.

Japanese Patent Laying-Open No. 60-73175 discloses a method for manufacturing a single-piece type sleeve using a cylindrical sleeve blank having a thick peripheral portion at each end, thicker than an intermediate portion thereof, the thick portions being deformed radially inwardly by a plastic-working method before the inner and outer surfaces of the cylindrical sleeve blank are machines. However, in such a manufacturing method, it is not easy to produce previously a cylindrical sleeve blank having different thickness at the ends and at the intermediate portion thereof, and the amount of excess material to be removed from the inner surface of the sleeve blank is large so that production costs become high. In addition, it is extremely difficult to improve productivity and accuracy.

SUMMARY OF THE INVENTION

The object of this invention is to provide, by solving the above-stated defects of the prior art, a method for manufacturing a single-piece type valve sleeve in which the production cost can be decreased, and productivity and accuracy can be improved.

This invention provides A method for manufacturing a single-piece type valve sleeve, including the steps of plastic-working a workpiece thereby to form in the workpiece a blind bore and a plurality of grooves in the surface of the bore, the grooves extending lengthwise of the bore and having one closed end at the bottom of the bore and an open end at the mouth of the bore, plastic-working a portion of the workpiece at the bottom of the bore so as to form a through hole in the workpiece, and plastic-working an inner portion of the workpiece adjacent the mouth of the bore thereby to close the open end of the grooves.

Typically, a workpiece is first formed with a blind bore and a plurality of grooves in an inner surface of, and extending lengthwise of, the bore. It is preferable that the grooves are formed by a front or back drawing method. Thereafter, a portion of the workpiece at the bottom of the bore is removed by plastic-working and, preferably, by punching so as to form a through hole in the workpiece while preferably leaving the inner ends of the grooves closed. Further, an inner portion of the workpiece adjacent the mouth of the bore is plastic-worked to be deformed, preferably, by extruding. As a result, the ends of the grooves adjacent the mouth of the bore are closed. After that, the inner surface of the workpiece is machined so that an accurate cylindrical through-hole is formed. Further, possibly the outer surface of the workpiece is machined as desired, e.g. some grooves or the like are additionally formed in the outer surface.

The above-mentioned steps may be carried out in a cold or hot condition.

Because a blind bore and a plurality of grooves positioned lengthwise in the bore are formed in a workpiece by a plastic-working method, and a portion of the workpiece at the bottom of the bore while leaving the inner ends of the grooves closed is removed by plastic-working, and an inner portion of the workpiece adjacent the mouth of the bore is further plastic-worked so as to be deformed, thereby to close the other ends of the grooves, grooves having both ends closed can be formed in the inner surface of a workpiece purely by a plastic-working method. Accordingly, it is possible to produce a single-piece type valve sleeve having a plurality of grooves therein by using solid materials which can be easily bought at a low price. No machining steps are required except the final step of machining the inner and outer surfaces of the workpieces. Therefore, the productivity can be improved, and the production cost can be remarkably decreased. In addition, accuracy in size of the grooves is excellent with a stabilized high quality. Further, materials can be saved. Using the preferred method, the grooves can be formed closed at one end thereof merely by plastic-working a workpiece while the other end of the grooves can be subsequently closed by plastic-working the workpiece. In this way, only some minor excess workpiece material extending radially inwardly at said other end of the grooves and other desired portions must be removed during the final machining step. This means that only a minor amount of excess material is cut at the final step. In addition, cutting thereof becomes easy so that the cost of producing a single-piece type valve sleeve can be further decreased.

When both ends of the grooves are closed by a plastic-working step as described, the outer shape of the workpiece is not changed. For this reason, the workpiece can be machined with high precision at the final stage. Thus, finished single-piece type valve sleeves may be made having excellent accuracy in size.

EMBODIMENT

Figure 1:
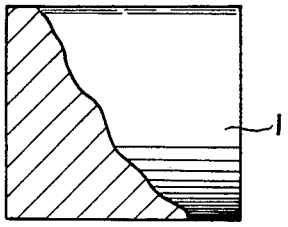
FIG. 1 is a front view showing, with some parts cut away, a workpiece which is used in a method for manufacturing a single-piece type valve sleeve according to this invention.

A single-piece type valve sleeve is manufactured in a cold or hot condition as follows:

FIG. 1 shows a workpiece 1 which has the same diameter over its entire length without any opening therein. Preferably, the workpiece 1 is produced by cutting a long cylindrical bar to a predetermined length.

Figure 2:
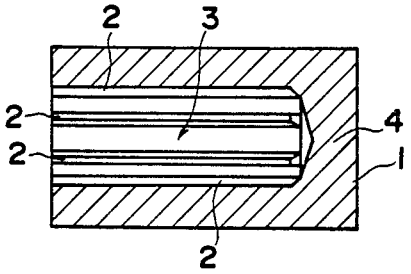
FIG. 2 is a sectional view showing a workpiece formed with a blind bore and a plurality of grooves by a plastic-working method.
Figure 3:
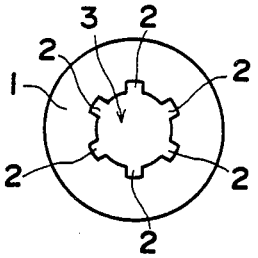
FIG. 3 is an end view showing the partly formed workpiece of FIG. 2.

The workpiece 1 is first formed with a blind bore 3 and a plurality of grooves 2 functioning as oil grooves, by plastic-working of the workpiece 1 as shown in FIGS. 2 and 3. The bore 3 and the grooves 2 are preferably formed by a back drawing method although they can be formed by a conventional front drawing method. The grooves 2 are orientated in the longitudinal direction of the bore 3, that is, the longitudinal direction of the workpiece 1 and are distributed equi-angularly in the bore.

Figure 4:
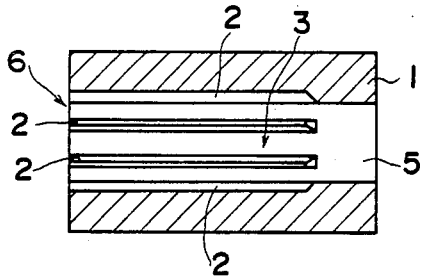
FIG. 4 is a sectional view showing a workpiece in which a portion at the bottom of the bore is punched so as to form a through-hole in the workpiece.
Figure 5:
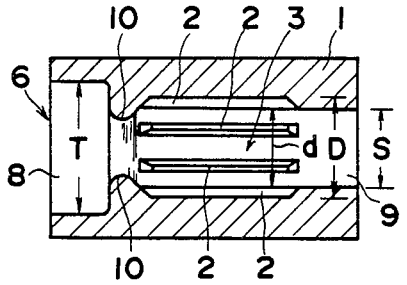
FIG. 5 is a sectional view showing a workpiece in which an inner portion of the workpiece adjacent the mouth of the original bore is pressed so as to be deformed.

Next, a portion 4 (see FIG. 2) of the workpiece at the bottom of the bore 3 is plastic-worked, preferably, by punching thereof, thereby to form with the bore 3 a through-hole 5, as shown in FIG. 4. As shown in FIG. 5, the inner diameter S of the punched portion of the hole 5 is substantially equal to the diameter d of the bore 3 between the grooves 2, 2 and may be slightly smaller. Accordingly, the right hand ends of the grooves 2 in FIG. 5 which are formed closed remain closed.

As shown in FIG. 5, an inner portion of the workpiece 1 is further plastic-worked through the open end 6 of the bore 3, preferably, by press-deforming the material of the workpiece. The inner diameter T of the inner wall 8 of the open end 6 is made larger than the diameter D of the bore 3. In this way, the other end of the grooves 2 are closed.

Figure 6:
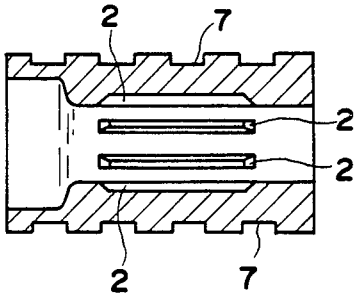
FIG. 6 is a sectional view showing a finished single-piece type valve sleeve after the inner and outer surfaces of the workpiece have been machined.

Finally, as shown in FIG. 6, the inner and outer surfaces of the workpiece 1 are machined, if desired, thereby to produce a finished single-piece type valve sleeve. For example, grooves 7 are additionally formed in the outer surface of the workpiece 1. Also, the inner walls 8, 9 and excess material 10 of the workpiece 1 shown in FIG. 5 are machined to a cylindrical form. The excess material 10 is also removed.

We claim:

1. A method for manufacturing a single-piece type valve sleeve, including the steps of:

plastic-working a workpiece thereby to form in the workpiece a blind bore and a plurality of grooves in the surface of the bore, the grooves extending lengthwise of the bore and having one closed end at the bottom of the bore and an open end at the mouth of the bore;

plastic-working a portion of the workpiece at the bottom of the bore so as to form a through hole in the workpiece; and plastic-working an inner portion of the workpiece adjacent the mouth of the bore thereby to close the open end of the grooves.

2. A method as defined in claim 1, wherein the grooves are formed by a back drawing method.

3. A method as defined in claim 1, wherein the grooves are formed by a front drawing method.

4. A method as claimed in claim 1, further including machining the workpiece as desired after performing said plastic working steps.

5. A method as claimed in claim 1, wherein the through-hole is formed by punching the portion of the workpiece at the bottom of the bore.

6. A method as defined in claim 1, wherein the workpiece is cold formed throughout.

7. A method as defined in claim 1, wherein the workpiece is hot formed throughout.

8. A method as defined in claim 1, wherein the inner portion of the workpiece is plastic-worked by press-deforming thereof.

* * * * *